US007237596B2

(12) United States Patent
Hanse et al.

(10) Patent No.: US 7,237,596 B2
(45) Date of Patent: Jul. 3, 2007

(54) THERMAL SHOCK RESISTANT CASTING ELEMENT AND MANUFACTURING PROCESS THEREOF

(75) Inventors: Eric Hanse, Feignies (FR); François Delvoye, Maubeuge (FR); Philippe Laval, Bossière (BE)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 10/509,501

(22) PCT Filed: Mar. 28, 2003

(86) PCT No.: PCT/BE03/00056

§ 371 (c)(1),
(2), (4) Date: Sep. 28, 2004

(87) PCT Pub. No.: WO03/082500

PCT Pub. Date: Oct. 9, 2003

(65) Prior Publication Data

US 2005/0156365 A1 Jul. 21, 2005

(30) Foreign Application Priority Data

Mar. 29, 2002 (EP) ..... 02447051

(51) Int. Cl.
*B22D 11/10* (2006.01)

(52) U.S. Cl. ..... 164/437; 164/488; 164/267; 222/594; 222/606; 106/286.8; 501/128

(58) Field of Classification Search ..... 164/488, 164/437, 267; 222/594, 606; 106/286.8; 501/128

See application file for complete search history.

(56) References Cited

U.S. PATENT DOCUMENTS

| | | | | |
|---|---|---|---|---|
| 4,951,852 | A * | 8/1990 | Rancoulle | 222/591 |
| 5,094,692 | A * | 3/1992 | Dumazeau | 106/286.8 |
| 5,328,878 | A * | 7/1994 | Kuszyk et al. | 501/98.6 |
| 5,840,433 | A * | 11/1998 | Juma | 428/632 |
| 6,283,341 | B1 * | 9/2001 | Muroi et al. | 222/606 |
| 6,380,114 | B1 * | 4/2002 | Brandy | 501/128 |

* cited by examiner

*Primary Examiner*—Kevin Kerns
*Assistant Examiner*—I.-H. Lin
(74) *Attorney, Agent, or Firm*—Thomas J. Clinton; Donald M. Satina

(57) ABSTRACT

The present invention concerns an element for the casting of a liquid metal, comprising a base body made from a refractory material, said body comprising an outer surface and an inner surface defining a pouring channel for the casting of the liquid metal. This element is characterized in that at least a part of the element inner surface is coated with an insulating coating forming, at the metal liquid contact, a gas impermeable layer. Such an element has an excellent thermal shock resistance which permits its use without preheating. Then a layer reducing advantageously the gas permeability is formed.

10 Claims, No Drawings

THERMAL SHOCK RESISTANT CASTING ELEMENT AND MANUFACTURING PROCESS THEREOF

CROSS-REFERENCE TO RELATED APPLICATION

This application is a 371 of PCT/BE03/00056 filed on Mar. 28, 2002.

BACKGROUND OF THE INVENTION

The present invention relates to a refractory element used for the transfer of molten metal. A particular case wherein the invention is very advantageous is a refractory tube for the transfer of steel from a ladle to a tundish and particularly such a tube when used without preheating.

Refractory elements used in molten metal casting are by nature, extremely sensitive to thermal shocks. When they are used, the elements contact metal and are subjected to important thermal shocks generating the formation of cracks, and this all the more when the temperature is low before their use. Consequently, the life time of these elements is reduced. Moreover, the cracks can permit air entries which can lead to downgrading the cast metal quality.

In order to improve the thermal shock resistance of the elements, a widely spread technique consists in preheating the element to temperature as close as possible to the use temperature. However, this technique requires to have a preheating zone near the use zone of the elements, consumes energy and consequently is expensive. Further, there is a minimum preheating time before which the element is not enough preheated to resist a thermal shock and a maximum preheating time beyond which the element starts to deteriorate. This process lacks also some flexibility since it does not allow to face an unexpected event, or too important deviation with respect to manufacturing planning.

Another technique well known by the skilled in the art and combined with that above described is the use of insulating fibers which are either glued, either cemented on the outside of the refractory element. In this case, the external coating permits to keep longer the heat acquired during the preheating and to increase its efficiency. However, the fibers which can support high temperatures (>1000° C.) necessary in these applications are toxic and their use is less and less authorized.

Document DE 38 05 334 A1 discloses another method permitting to improve the thermal shock resistance of such elements. This method consists in introducing in the pouring orifice of the element a sleeve made from a fibrous or foaming ceramic material. This method has several drawbacks. When a foaming ceramic material is used, to form it, it is necessary to use foaming or tensioactive-agents which are generally incompatible with refractory elements, particularly if they are constituted from carbon bonded material. It can also be difficult to control the foam so as to form a layer of relatively constant thickness and showing reproducible insulating properties. The so obtained insulation is thus not homogenous and can cause detrimental temperature gradients inside the element. When the element has a complex geometry, which is more and more frequent to improve the cast metal quality, the manufacturing and the positioning of the sleeve is specially uneasy, in particular to ensure a continuous contact between the sleeve and the element. As the sleeve is not integral with the element, it can move or even come off during the handling or usage of the element when contacting the metal. Parts of the sleeve can obstruct the element, form a plug or, at least, make uneasy the passage of molten metal since the metal cannot flow normally in the lower metallurgical vessel; it can then leak through the joints bonding the refractory elements to one another.

In the particular case of refractory pouring tube, intended for the transfer of a molten metal from a casting ladle to a tundish, these being generally tubes made from graphite based materials and carbon bonded (alumina/graphite, magnesia/graphite, . . . ), the most often used method is certainly the one consisting in pre-oxidizing the inner surface of the tube so as to form a layer without or with only a reduced carbon percentage. This low carbon content oxidized layer is a layer that shows a low thermal conductivity coefficient with respect to the body of the tube. It acts as a barrier at the beginning of the casting and permits to the refractory tube to resist the thermal shock of the first contact with the molten metal. This method, although generally satisfactory, has nevertheless some drawbacks. The oxidized layer is obtained during the firing of the refractory tube under oxidizing atmosphere. It is therefore quite uneasy to obtain an homogenous layer of constant thickness all along the element. The thickness of the oxidized layer can vary significantly (2 to 10 mm) from one tube to another or from one region to another of the same tube. This does not permit to have homogenous insulating properties. Further, this layer having lost its carbon binder is washed away in a few minutes at the contact of the molten metal. The thickness of the tube is therefore quickly reduced of the thickness of the layer; this reduces significantly the mechanical resistance and its time life.

The object of the present invention is a casting element having an increased thermal shock resistance and which does not have the drawbacks of the above mentioned prior art. Moreover, it would be desirable to propose a refractory element having improved properties, particularly a gas permeability significantly reduced with respect to the element of the state of the art.

BRIEF SUMMARY OF THE INVENTION

The casting element according to the invention comprises a base body made from a refractory material. This base body comprises an outer surface and an inner surface defining a pouring channel for the casting of the liquid metal.

The present invention is based on the observation that the thermal shock resistance properties are essentially useful at the beginning of the use of the non preheated element. It is indeed necessary that such an element can resist important thermal shock (passage from the room temperature to the molten metal temperature) in a very short time (a few seconds). Later, the element being used at its regime temperature, it is not any longer subjected to so important temperature variations and its thermal shock resistance becomes less crucial. It is to be noted that a temporary stop of the casting operation (for example when the casting ladle is changed) does not allow a cooling of the element beyond a critical point and does not lead to important thermal shock. On the other hand, once the temperature regime reached, it would be desirable to take into account other quality factors of the casting elements such as the non-permeability to gas. In particular, it would be highly desirable to ensure a good thermal shock resistance of the element at the beginning of its use (cold start) and a good gas impermeability during the continuation of its use.

The casting element according to the invention is characterized in that at least a part of the element inner surface is coated with an insulating coating forming, at the metal liquid contact, a gas impermeable layer. The insulating coating covering the cold element permits to the element to resist the thermal shock at the start of its use, i.e. when the liquid metal contacts the inner part of the element. The impermeable layer formed at the contact with the liquid metal provides gas impermeability to the element, the air entries will therefore be reduced or even eliminated and the cast metal quality improved. Generally, such an impermeable layer is generated after from a few seconds to a few minutes.

The coating comprises components providing for its insulating properties as well as components that will promote the formation of an impermeable layer at the contact with the liquid metal. It must be noted that the same component can play both roles. The components of the coating providing for the insulating properties are for example insulating microspheres. The coating components able to form an impermeable layer at the casting temperatures are for example silica and alumina.

DETAILED DESCRIPTION OF THE PREFERRED EMBODIMENTS

According to an embodiment of the invention, the coating comprises from 20 to 80% by weight of a ceramic matrix, 5 to 40% by weight of insulating microspheres, from 0.5 to 15% by weight of one or more binders, and up to 5% of water. The coating can also comprise 5 to 20% by weight of a metal or a metallic alloy so as to improve the continuity of the coating and, consequently, the texture of the coating. According to a particular case, the ceramic matrix comprises silica or alumina, for example, vitreous grains such a atomized silica. Atomized silica being extremely fine, it has the advantage of easily penetrating inside the porosity of the element body and, therefore, bond the coating and the body material. Insulating microspheres comprise also, for example, silica and/or alumina.

Some of the components of the coating forming the gas impermeable layer can react with some components contained in the liquid metal as well as with some components contained in the casting element body material. The result of these reactions are low melting point phases, molten or vitreous at use temperature which cover and make impermeable the surface of the element. It has been noted that, advantageously, these phases show a relatively high viscosity permitting an excellent bonding to the inner surface of the element. In particular, these phases are not damaged during the first cleanings of the element, for example with oxygen. It has been noted that these reactions take place even when these components are present in a very low amount. The components of the metal suitable to participate to these reactions are for example calcium, magnesium or manganese. The components of the element body material are for example magnesia and mullite.

In a particular embodiment, the casting element is a ladle shroud, for example in a carbon bonded refractory material not pre-heated before its use.

The thickness of the coating can vary from 1 to 10 mm, good results have been obtained with a thickness of from 3 to 5 mm.

The insulating coating is applied on a part of the inner surface of the casting element. According to an embodiment of the invention, the coating shows a structure and a grain size distribution such that the coating and the material forming the body of the casting element are bonded one to the other, the coating penetrating into the porosity of the material, for example by wetting or capillary action. There is thus an inter-penetration of the body material and the coating which become integral.

The element coating will turn, in use, into an impermeable layer which will remain integral with the casting element body material.

In order to improve the thermal shock resistance, several layers of the coating can be necessary, for example for hard applications.

A layer of an insulating coating similar or different of the one according to the invention can also be applied on a part of the external surface of the casting element, for example on a part of the external surface of the element likely to be immersed into the liquid metal. This part must indeed resist the inner thermal shock during the first passage of the liquid metal as well as the thermal shock at the immersion into the liquid metal.

The present invention relates also to a process for coating a casting element characterized in that at least a part of the element inner surface is coated with an insulating coating forming, at the metal liquid contact, a gas impermeable layer, said casting element comprising a base body made from a refractory material, said body comprising an outer surface and an inner surface defining a channel.

The coating can be applied on the tube surface by spraying, brushing or even by dipping into an aqueous solution or a slip. It is also possible to simply pour an aqueous solution or slip through the channel defined by the inner surface of the element. In the scope of the present invention, it is meant by slip a suspension in water or in another liquid of fine particles (with a dimension lower than 50 μm) or of such a suspension comprising further coarse particles (with grains having a dimension of up to 2 mm).

The inter-penetration of the coating and the element body material is promoted when the coating is prepared as an aqueous solution or a slip, applied to the element and then dried, for example in the open air. A coating which have provided excellent results is a coating comprising 20 to 80 weight % atomized silica with respect to the total weight of the coating. The atomized silica is indeed easily converted into a slip and penetrates easily into the element body material porosity.

In an embodiment of the invention, a coating comprising 20 to weight 80% of a ceramic matrix, 5 to 40 weight % of insulating microspheres, from 0.5 to 15 weight % of one or more binders and up to 5% of water is prepared as a slip, said slip is contacted with the surface of the element to be coated and is then dried for at least two hours.

The coating can also comprise from 5 to 20% by weight of a metal or metal alloy so as to improve the coating process of the element and reduce the formation of cracks during the drying.

EXAMPLE

A carbon bonded pouring shroud constituted from alumina graphite, the inner surface of which as not been oxidized is used. A coating comprising:

12.1% water
2.9% dextrin
7.8% colloidal silica
1.7% dolapix CE 64

(dolapix CE 64 is a defloculating agent from the German company ZCHIMMER & SCHWARZ AG.)

8.6% fillite
4.1% clay 42.9% atomized silica
10.7% alumina
9.1% aluminum (metal)
0.1% sodium tripolyphosphate is prepared under the form of a slip. The end of the tube is plugged with a rubber tab. The inside of the tube is filled with the slip. After from 20 to 30 seconds, the end of the tube is open and the slip in excess is evacuated. The inner surface of the tube is thus coated with a coating layer having an essentially constant thickness. The coating and the tube material being interconnected. The element is then dried in open air for about two hours.

An element prepared according to the example has been compared to a known element comprising a 5 mm oxidized layer on its inner surface. After use, the element according to the invention showed no cracks and its time life was much longer than this of the state of the art element.

The inner surface of the element according to the invention was covered with a layer having a vitreous appearance and gas impermeable. This molten layer comprised, among other, calcia aluminates, calcia silico-aluminates and manganese silicate.

For certain critical applications where a preheating would still be required, the coating according to the present invention is able to resist such a preheating.

The invention claimed is:

1. A pouring shroud for the casting of a liquid metal, comprising a base body made from a refractory material, said body comprising an outer surface and an inner surface defining a pouring channel for the casting of the liquid metal, wherein at least a part of the inner surface is coated with an insulating coating comprising insulating hollow microspheres, preferably in an amount comprised between 5 and 40 weight % and forming, at the metal liquid contact, a gas impermeable layer, and wherein the pouring shroud is suitable for use prior to being preheated.

2. A pouring shroud according to claim 1, wherein the coating comprises 20 to 80 weight % of a ceramic matrix.

3. A pouring shroud according to claim 2, wherein the ceramic matrix comprises silica or alumina.

4. A pouring shroud according to claim 3, wherein the ceramic matrix comprises vitreous grains.

5. A pouring shroud according to claim 4, wherein the vitreous grains comprise atomized silica.

6. A pouring shroud according to claim 1, wherein the thickness of the coating is between 1 and 10 mm.

7. A pouring shroud according to claim 1, wherein the impermeable layer and the refractory material are interpenetrated.

8. A pouring shroud according to claim 1, wherein the base body is constituted from a carbon bonded material.

9. A pouring shroud according to claim 1, wherein at least a part of the external surface is coated with an insulating coating comprising insulating microspheres.

10. A pouring shroud according to claim 9, wherein the insulating microspheres comprise between 5 and 40 weight % of the insulating coating.

* * * * *